US011070901B2

(12) United States Patent
Wu et al.

(10) Patent No.: US 11,070,901 B2
(45) Date of Patent: Jul. 20, 2021

(54) THIN-TYPE PHONE RECEIVER

(71) Applicant: SUZHOU YICHUAN ACOUSTIC TECHNOLOGY CO., LTD, Suzhou (CN)

(72) Inventors: Yiqian Wu, Suzhou (CN); Xiaoming Chen, Suzhou (CN)

(73) Assignee: SUZHOU YICHUAN ELECTRONIC TECHNOLOGY CO., LTD, Jiangsu (CN)

( * ) Notice: Subject to any disclaimer, the term of this patent is extended or adjusted under 35 U.S.C. 154(b) by 0 days.

(21) Appl. No.: 16/632,293

(22) PCT Filed: Feb. 28, 2019

(86) PCT No.: PCT/CN2019/076442
§ 371 (c)(1),
(2) Date: Jan. 17, 2020

(87) PCT Pub. No.: WO2020/057059
PCT Pub. Date: Mar. 26, 2020

(65) Prior Publication Data

US 2021/0127192 A1 Apr. 29, 2021

(30) Foreign Application Priority Data

Sep. 20, 2018 (CN) ..... 201811102459.7
Jan. 28, 2019 (CN) ..... 201910082003.7

(51) Int. Cl.
*H04R 1/10* (2006.01)
*H04R 1/28* (2006.01)
(Continued)

(52) U.S. Cl.
CPC ..... *H04R 1/10* (2013.01); *H04R 1/2807* (2013.01); *H04R 7/04* (2013.01); *H04R 11/02* (2013.01); *H04R 2499/11* (2013.01)

(58) Field of Classification Search
CPC . H04R 1/10; H04R 7/04; H04R 11/02; H04R 2499/11
See application file for complete search history.

(56) References Cited

U.S. PATENT DOCUMENTS

2009/0161906 A1* 6/2009 Adelman ..... H04R 11/02 381/418

FOREIGN PATENT DOCUMENTS

CN 103067808 B 12/2014
CN 107454521 A 12/2017
(Continued)

OTHER PUBLICATIONS

Office Action of the European Patent Office dated Sep. 18, 2020.
(Continued)

*Primary Examiner* — Sunita Joshi
(74) *Attorney, Agent, or Firm* — Seyfarth Shaw LLP

(57) ABSTRACT

The present application provides a thin-type phone receiver, comprising a housing, a vibration membrane assembly and a coil. The vibration membrane assembly comprises a frame, a diaphragm and a sealing membrane. The coil is sealedly fixed in the mounting area and sealedly sleeved on the frame, and the spreading sealing membrane seals an entirety of a first gap between the frame and the diaphragm, thereby, the vibration membrane assembly separates a mounting cavity of the housing into two cavities that are arranged side by side and separate. When the coil is energized and an electromagnetic field generated by the coil interacts with a fixed magnetic field of the permanent magnets in the phone receiver, the entire diaphragm vibrates, thus, as the coil is sleeved on the vibration membrane assembly to form the thin-type phone receiver.

14 Claims, 15 Drawing Sheets

(51) Int. Cl.
*H04R 7/04* (2006.01)
*H04R 11/02* (2006.01)

(56) References Cited

FOREIGN PATENT DOCUMENTS

| | | | | |
|---|---|---|---|---|
| CN | 207022205 | U | * | 2/2018 |
| CN | 207022205 | U | | 2/2018 |
| CN | 207612419 | U | | 7/2018 |
| CN | 109104663 | A | | 12/2018 |

OTHER PUBLICATIONS

SHP201900002US_N1_International Search Report (ISR).
SHP201900002US_N2_Written Opinion by International Searching Authority (ISA).
European Search Report, dated Jul. 6, 2020.
Office Action of the Japanese Patent Office dated Mar. 4, 2021.
Office Action of the European Patent Office dated Mar. 5, 2021.

* cited by examiner

THIN-TYPE PHONE RECEIVER

TECHNICAL FIELD

The present application relates to the field of acoustic technology, and particularly relates to a thin-type phone receiver.

BACKGROUND

A phone receiver is an electroacoustic device for converting audio electric signal into sound signal, without leak of sound, and is widely used in telecommunication terminal devices, such as mobile telephones, landline telephones and earphones, for realizing audio output.

For example, the phone receiver disclosed by Chinese patent literature CN103067808B comprises an upper casing and a lower casing with mutually buckled openings, wherein the upper casing further comprises a first casing, a third casing and a second casing connected in sequence; an E-shaped spring piece, with a coil sleeved on a root segment of the middle arm of the E-shaped spring piece, wherein an end portion of the middle arm extending out of the coil and hanging in the air serves as a vibration part; the coil being positioned in an area between the second casing and the lower casing, the phone receiver also comprises a first permanent magnet fixed on the first casing and a second permanent magnet fixed on the lower casing; and a membrane having one end fixed on the third casing and the other end spreading forward on the vibration part of the E-shaped spring piece and fixed on the first casing, but not spreading on the portion of the spring piece with the coil sleeved thereon; the membrane separates an enclosed cavity inside the housing into a sound-producing cavity, surrounded by the third casing, the membrane and the first casing, and a mounting cavity, surrounded by the lower casing, the second casing and the membrane.

With respect to the phone receiver having this structure, because the membrane only covers on the vibration part, when the coil is energized, an electromagnetic field generated by the coil interacts with a fixed magnetic field of the two permanent magnets, so as to cause the vibration part to vibrate together with the membrane to drive the air inside the sound-producing cavity to vibrate and produce sound. It can be seen that, as for the spring piece of this phone receiver, only its vibration part with the membrane spreading thereon contributes to sound production, while the portion of the spring piece with no membrane spreading thereon does not contribute to sound production, and as a result, the effective area of the spring piece contributing to sound production is small, which leads to low loudness of the phone receiver and adversely affects the sound-producing performance of the phone receiver. And because it is provided with the third casing, the structure of the phone receiver becomes complicated, and the difficulty level of its manufacturing process is increased.

SUMMARY OF THE INVENTION

Hence, a technical problem to be solved by the present application is the defect that, in the thin-type phone receiver of prior art, with the coil sleeved on the root segment of the spring piece, the spring piece has a small portion that contributes to sound production, causing the sound produced by the phone receiver to have low loudness.

Thus, the present application provides a thin-type phone receiver which comprises a housing, having a mounting cavity;

a vibration membrane assembly, comprising a frame sealedly fixed on the housing with a mounting area surrounded by a part of a side wall of the frame and an inner wall of the housing, a diaphragm at least partially made of soft magnetic material and fixed on the frame with one end of the diaphragm hanging in an inner space of the frame, and a sealing membrane which sealedly covers an entirety of a first gap between the diaphragm and the frame;

a coil, sealedly fixed in the mounting area and sealedly sleeved on the frame;

wherein the vibration membrane assembly separates the mounting cavity into a first cavity and a second cavity that are arranged side by side and not communicated with each other.

Optionally, in the aforementioned thin-type phone receiver, a fixed end of the diaphragm on the frame extends into an inner hole of the coil.

Optionally, in the aforementioned thin-type phone receiver, the diaphragm comprises a first portion fixed on the frame and extending into the inner hole of the coil, and a second portion formed on the first portion and hanging outside the coil; and the second portion has a width in a radial direction of the coil larger than that of the first portion.

Optionally, in the aforementioned thin-type phone receiver, the second portion has a thickness not equal to that of the first portion.

Optionally, in the aforementioned thin-type phone receiver, the second portion is provided with a regulating aperture extending in the same direction as the first gap.

Optionally, in the aforementioned thin-type phone receiver, the frame comprises a first mounting segment sealedly fixed in the inner hole of the coil and forming the mounting area with the housing, and a second mounting segment placed outside the coil and fixed on the first mounting segment, wherein, the second mounting segment has a width in a radial direction of the coil larger than that of the first mounting segment, one end of the coil facing the second mounting segment is sealedly fixed on the second mounting segment, and the coil is sealedly fixed to the housing.

Optionally, in the aforementioned thin-type phone receiver, the frame also comprises a first extension part bending towards the second cavity and arranged on at least one end of the second mounting segment, wherein the first extension part is sealedly fixed to an inner hole wall of the coil.

Optionally, in the aforementioned thin-type phone receiver, the frame also comprises at least two support parts formed on an end portion of the second mounting segment for fixing the first mounting segment and located on both sides of the first mounting segment; wherein the support parts are fixed on the housing and surround the mounting area with the first mounting segment, an outer wall of the coil is fixed on the support parts.

Optionally, in the aforementioned thin-type phone receiver, the coil is fixed by sealant adhesive to the second mounting segment, the first mounting segment and the housing.

Optionally, in the aforementioned thin-type phone receiver, the diaphragm comprises a diaphragm body with one end formed on the frame and the other end hanging in the inner space of the frame; and at least one spring plate, fixed on the diaphragm body, made of soft magnetic material and extending on the diaphragm body at least from an inner hole of the coil in an extending direction of the first gap;

wherein, the diaphragm body is made of non-magnetic-conducting material, and the sealing membrane is fixed on the diaphragm body and the frame.

Optionally, in the aforementioned thin-type phone receiver, the housing comprises a first casing and a second casing with mutually buckled openings; and the frame is clamped and fixed between the openings of the first casing and the second casing.

Optionally, in the aforementioned thin-type phone receiver, at least one reinforcing rib is provided on one side surface of the diaphragm; and/or the sealing membrane is spreading and fixed on the frame and the diaphragm.

Optionally, in the aforementioned thin-type phone receiver, at least one positioning part is provided on an inner hole wall of the coil, and the coil is sleeved on the frame through the positioning part.

Optionally, in the aforementioned thin-type phone receiver, the positioning part is a groove recessed inward on the inner hole wall of the coil; and a lateral end of the frame is embedded in the groove adjacent thereto.

Further optionally, in the aforementioned thin-type phone receiver, the groove has a U-shaped cross section or a V-shaped cross section; or the groove has a cross-section including a U-shaped part and an inverted-trapezoidal-shaped part joined to an opening of the U-shaped part, and a longer edge side of the inverted-trapezoidal-shaped part forms a groove opening of the groove.

Further optionally, the aforementioned thin-type phone receiver comprises two of the positioning parts symmetrically disposed on the inner hole wall of the coil.

The technical solution of the present application has the following advantages:

1. The thin-type phone receiver provided by the present application comprises a housing, a vibration membrane assembly and a coil. The vibration membrane assembly comprises a frame, a diaphragm and a sealing membrane. Because a mounting area is formed by a part of a side wall of the frame and an inner wall of the housing, the coil is sealedly fixed in the mounting area and sealedly sleeved on the frame, and the sealing membrane seals an entirety of a first gap between the frame and the diaphragm, thereby, the vibration membrane assembly separates a mounting cavity of the housing into two cavities that are arranged side by side and not communicated with each other.

When the coil is energized and an electromagnetic field generated by the coil interacts with a fixed magnetic field of two permanent magnets in the phone receiver, because the inner hole of the coil is sealedly connected to the frame, the coil is sealedly connected in the mounting area, and the sealing membrane seals the entirety of the first gap between the frame and the diaphragm, so the portion of the diaphragm inside the inner hole of the coil can also generate vibration, thereby making the entire diaphragm all contribute to vibration, so as to drive the air inside the first cavity or the air inside the second cavity to vibrate and produce sound, therefore, as the coil is sleeved on the vibration membrane assembly to form the thin-type phone receiver, all the portions of the diaphragm covered with the sealing membrane contribute to sound production, so that an effective area of the diaphragm for vibrating is maximized, thereby increasing the loudness of the phone receiver and improving the sound-producing performance of the phone receiver.

BRIEF DESCRIPTION OF THE DRAWINGS

In order to more clearly describe the technical solutions in the specific embodiments of the present application or in the prior art, hereinafter, the appended drawings used for describing the specific embodiments or the prior art will be briefly introduced. Apparently, the appended drawings described below are only some embodiments of the present application, and for a person with ordinary skill in the art, without expenditure of creative labor, other drawings can be derived on the basis of these appended drawings. In the drawings.

REFERENCE SIGNS

1—housing, 11—first casing, 12—second casing, 13—first cavity, 111—sound outlet hole, 14—second cavity;

21—frame, 211—first mounting segment, 212—second mounting segment, 213—first extension part, 214—support part, 215—second extension part, 22—diaphragm, 221—fixed end, 222—hanging end, 223—diaphragm body, 224—spring plate, 225—regulating hole, 226—reinforcing rib, 23—sealing membrane, 24—first gap;

3—coil, 31—positioning part, 32—inner hole;

41—first permanent magnet, 42—second permanent magnet.

DETAILED DESCRIPTION OF EMBODIMENTS

A clear and complete description of the technical solution of the present application is given below, in conjunction with the appended drawings. Apparently, the described embodiments are part of, but not all of, the embodiments of the present application. All the other embodiments, obtained by a person with ordinary skill in the art on the basis of the embodiments in the present application without expenditure of creative labor, belong to the protection scope of the present application.

Embodiment 1

The present embodiment provides a thin-type phone receiver, as shown in FIG. 1 to FIG. 4, comprising a housing 1, a vibration membrane assembly, a coil 3 and two permanent magnets.

Wherein, the housing 1 comprises a first casing 11 and a second casing 12 having respective openings, wherein a bottom opening of the first casing 11 is positioned opposite to and buckled with a top opening of the second casing 12, thereby surrounding an enclosed or closed mounting cavity. Optionally, the first casing 11 and the second casing 12 are both made of high-magnetic-conductivity material, such as high-magnetic-conductivity nickel alloy material.

Figure 2:
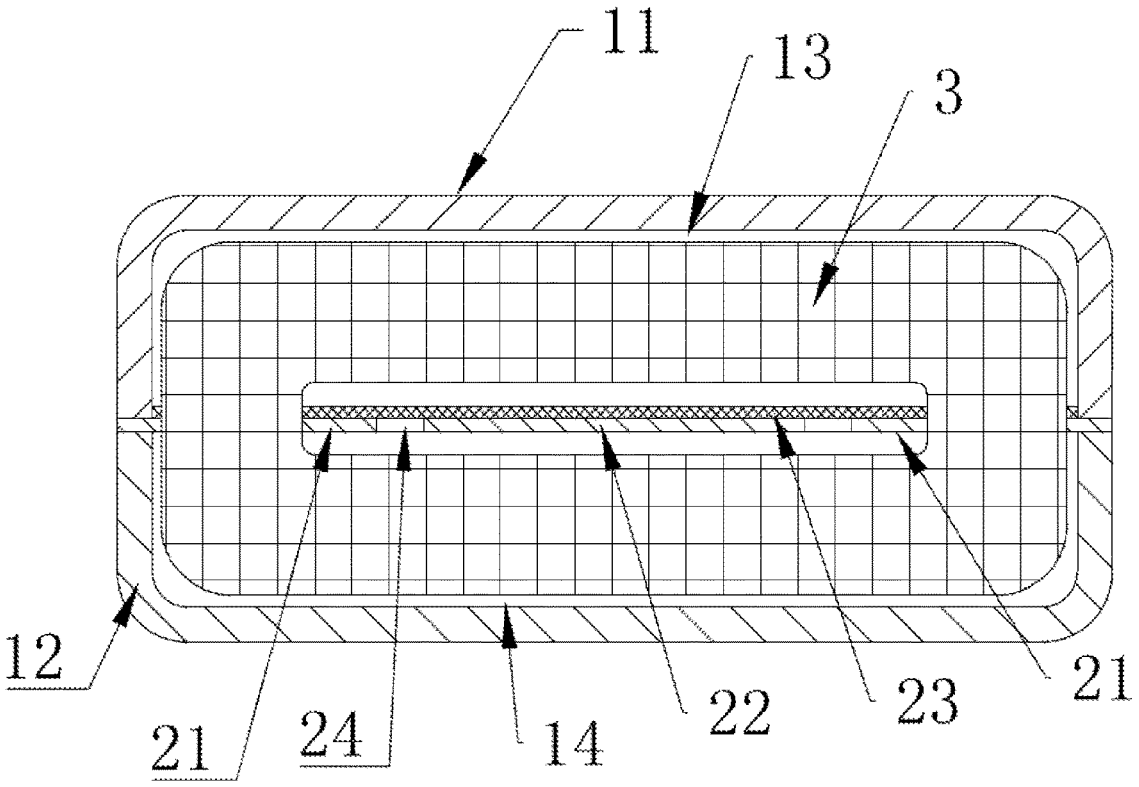
FIG. 2 is a cross-sectional schematic diagram (in the fore-and-aft direction) of the phone receiver of FIG. 1.
Figure 3:
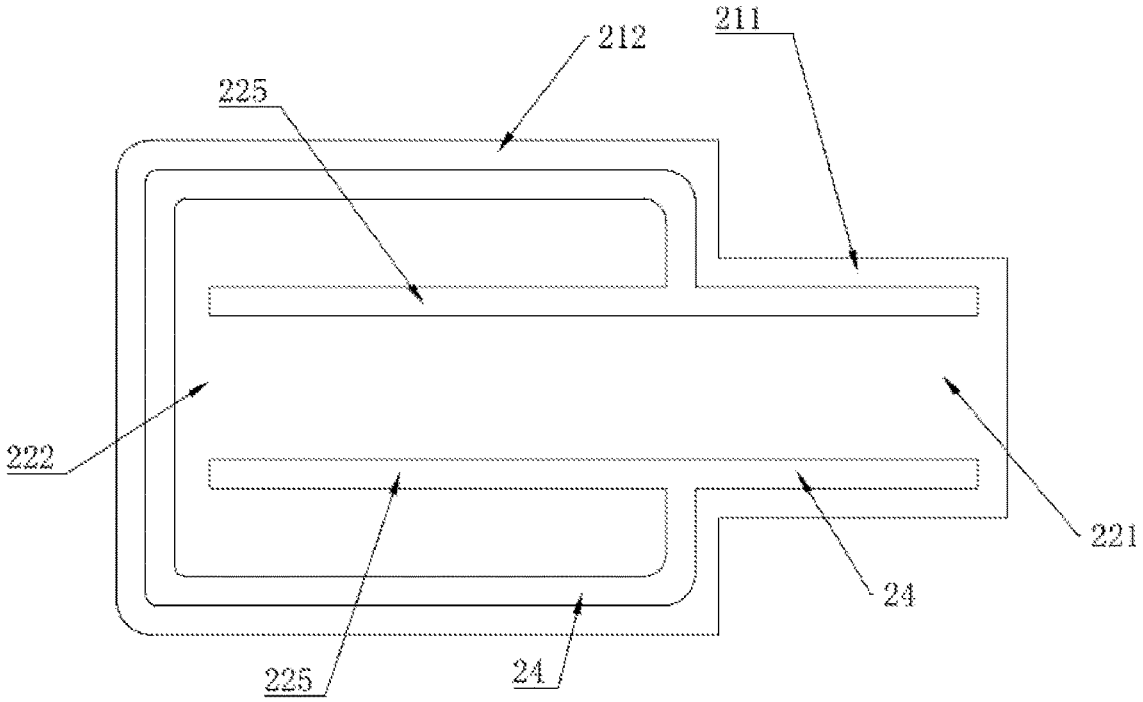
FIG. 3 is a schematic diagram of a structure of the vibration membrane assembly in FIG. 1.
Figure 4:
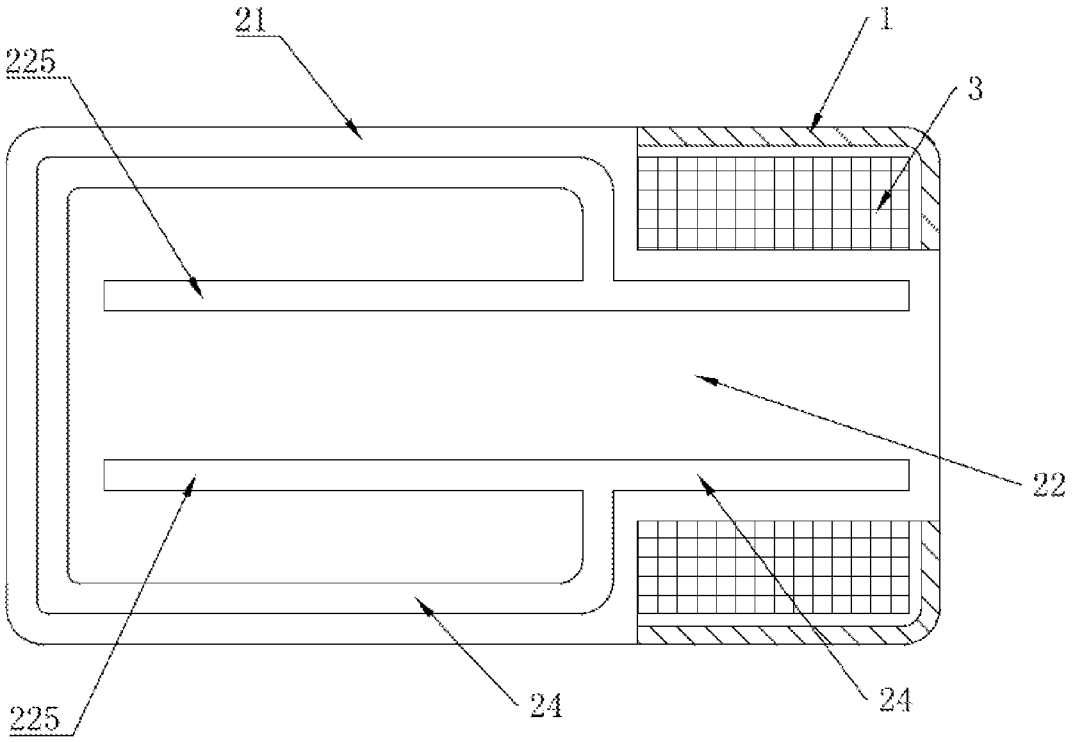
FIG. 4 is a partial schematic diagram of the phone receiver in FIG. 1, after the first casing and the first permanent magnet are removed.

As shown in FIG. 2, FIG. 3 and FIG. 4, the vibration membrane assembly comprises a frame 21, a diaphragm 22 and a sealing membrane 23, wherein the frame 21 is clamped between the openings of the first casing 11 and the second casing 12, for example, laser welding is performed to sealedly and fixedly connect the bottom opening of the first casing 11, the frame 21 and the top opening of the second casing 12.

A mounting area is surrounded by a part of a side wall of the frame 21 and an inner wall of the housing 1, and optionally, the mounting area has an annular shape. For instance, as shown in FIG. 3, the frame 21 comprises a first mounting segment 211 and a second mounting segment 212 fixed on the first mounting segment 211, wherein the second mounting segment 212 has a width in a radial direction of a coil 3 (to be described later) larger than that of the first mounting segment 211, so that the frame 21 has a T-shape, the mounting area is delimited between a side wall of the first mounting segment 211 and the inner wall of the housing 1, the second mounting segment 212 is entirely fixed between the openings of the first casing 11 and the second casing 12, and one end of the first mounting segment 211 away from the second mounting segment 212 is fixed between the openings of the first casing 11 and the second casing 12.

For example, in FIG. 3, a right end of the first mounting segment 211 is sealedly and fixedly clamped between the openings of the first casing 11 and the second casing 12, and the second mounting segment 212 has its left end, front end and rear end all fixed between the openings of the first casing 11 and the second casing 12.

The diaphragm 22 is made of soft magnetic material, as shown in FIG. 3, one end of the diaphragm 22 is formed on an inner wall of the first mounting segment 211 of the frame 21, and the other end of the diaphragm 22 extends towards the second mounting segment 212 and is hanging in an inner space of the frame 21, wherein an outer peripheral wall of the diaphragm 22 forms a first gap 24 with an inner wall of the frame 21.

Similar to the structure of the frame, the diaphragm 22 also comprises a first portion fixed on the first mounting segment 211 of the frame 21 and extending into an inner hole of the coil 3, and a second portion formed on the first portion and hanging outside the coil 3, wherein the second portion has a width in a radial direction of the coil 3 larger than that of the first portion, so as to form a T-shape.

Figure 5:
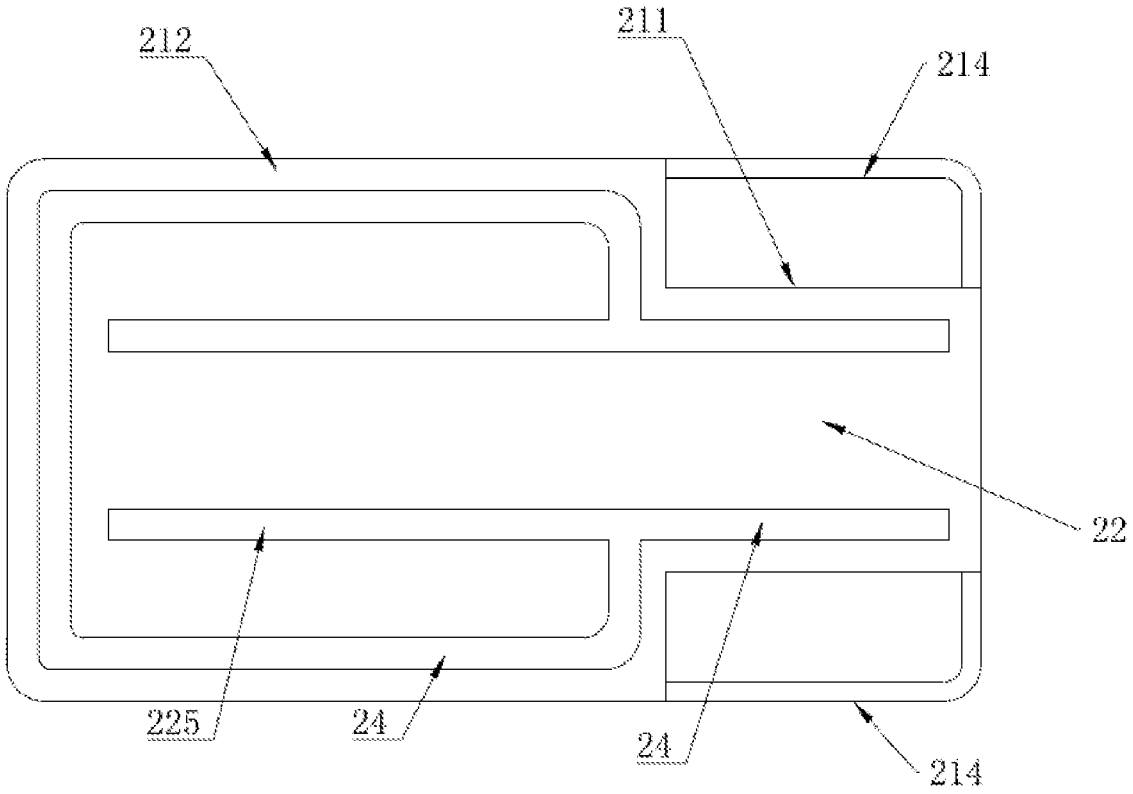
FIG. 5 is a schematic diagram of another kind of structure of the vibration membrane assembly in FIG. 1.

As shown in FIG. 5, the frame 21 also comprises two support parts 214 formed on an end portion of the second mounting segment 212 for fixing the first mounting segment 211 and located on both sides of the first mounting segment 211, wherein the other end of each of the two support parts 214 is bent and respectively fixed on either lateral wall of the first mounting segment 211, so that the two support parts 214 surround the first mounting segment 211, for example, each support part 214 has an L-shaped horizontal cross section; the support parts 214 are fixed on the housing 1 and surround the mounting area with the first mounting segment 211, and an outer wall of the coil 3 is fixed on the support parts 214.

By arranging the support parts 214 on the second mounting segment 212, the entirety of the frame is made to have a rectangular shape, with the mounting area surrounded between the support parts 214 and the first mounting segment 211, and when the frame 21 is mounted between the openings of the first casing 11 and the second casing 12, due to the arrangement of the support parts 214, the end faces of the openings of the first casing 11 and the second casing 12 are flush, so that the frame 21 can be fixed smoothly at level, thereby making it easy to mount the phone receiver.

Figure 1:
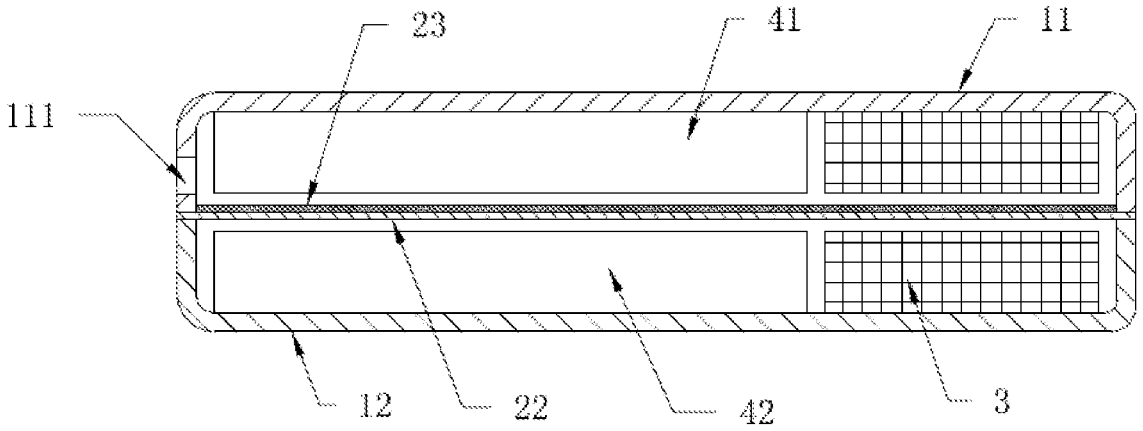
FIG. 1 is a cross-sectional schematic diagram (in the left-and-right direction) of a phone receiver provided in Embodiment 1 of the present application.

As shown in FIG. 1, the sealing membrane 23 is fixed on top of the frame 21 and the diaphragm 22 and covers an entirety of the first gap 24. The sealing membrane 23 may be spreading on the entire frame and the entire diaphragm, or may only be fixed on portions of the frame and the diaphragm where both lateral sides of the first gap are located. The sealing membrane 23 may be made of high polymer material, such as PET or PEE, and preferably the sealing membrane 23 is connected to the frame 21 and the diaphragm 22 by adhesive.

As shown in FIG. 1 and FIG. 4, the coil 3 is sealedly fixed in the mounting area and sleeved on the first mounting segment 211 of the frame 21, one end of the coil 3 facing the second mounting segment 212 is sealedly fixed on the second mounting segment 212, the other end of the coil 3 facing the housing 1 is sealedly fixed on the housing 1, the outer circumferential wall of the coil 3 is entirely sealedly fixed on an inner wall of the housing 1, the inner hole wall of the coil 3 is sealedly fixed on a side wall of the first mounting segment 211, but a vibration gap is reserved between the diaphragm 22 and the inner hole of the coil 3.

For instance, sealant adhesive is used to fix the coil 3 to the housing 1, the second mounting segment 212 and the first mounting segment 211, thus, the vibration membrane assembly separates the mounting cavity of the housing 1 into a first cavity 13 and a second cavity 14 that are arranged side by side and not communicated with each other, for example, the inner cavity of the first casing 11 is the first cavity 13, the inner cavity of the second casing 12 is the second cavity 14, and a sound outlet hole 111 is provided in the first casing 11. Or, the first casing 11 is not provided with any sound outlet hole, and instead the second casing is provided with a sound outlet hole, and the sound outlet hole can merely be provided in a wall of a housing part where the first cavity or the second cavity is located.

It needs to be noted that, although the enclosed mounting cavity of the housing 1 refers to a closed mounting cavity, in view of that a sound outlet hole needs to be provided in the housing to make a phone receiver, the closed mounting cavity does not mean it is absolutely isolated from the external environment, actually, it is for forming a first cavity and a second cavity sealedly separated from each other, with a sound outlet hole to communicated with the external environment.

Optionally, the coil 3 is provided with a positive lead wire and a negative lead wire passing through the housing 1 to be connected respectively to a bonding pad outside the housing 1.

The two permanent magnets are respectively named as a first permanent magnet 41 and a second permanent magnet 42 for convenience of description, as shown in FIG. 1, the first permanent magnet 41 and the second permanent magnet 42 are respectively fixed on an inner wall of the first casing 11 and the second casing 12 and positioned opposite to each other, with the mutually opposing ends of the first permanent magnet 41 and the second permanent magnet 42 having opposite polarities, for example, the polarity of the end of the first permanent magnet 41 facing the second permanent magnet 42 is S-pole, and correspondingly the polarity of the end of the second permanent magnet 42 facing the first permanent magnet 41 is N-pole. The two permanent magnets avoid the location of the coil 3 and are located on both sides of the hanging end 222 of the diaphragm 22.

In the phone receiver of the present embodiment, the frame 21 is spreading and fixed between the openings of the first casing 11 and the second casing 12, the coil 3 is sealedly sleeved on the side wall of the first mounting segment 211 of the frame 21, a vibration gap is reserved between the diaphragm 22 and the inner hole of the coil 3, and the sealing membrane 23 covers the entire diaphragm 22 and frame 21. When the coil 3 is energized in a positive direction, the coil 3 generates an electromagnetic field, and because the diaphragm 22 is made of soft magnetic material, the electromagnetic field magnetizes the diaphragm 22 to cause the diaphragm 22 to take on magnetic property, for example, the hanging end 222 of the diaphragm 22 takes on N-pole, the S-pole of the first permanent magnet 41 exerts an upward attracting force on the diaphragm 22, and the N-pole of the second permanent magnet 42 exerts an upward repelling force on the diaphragm 22, so that the diaphragm 22 is caused to vibrate upward in the mounting cavity, so as to vibrate the sealing membrane 23, thereby driving the air inside the first cavity 13 to vibrate and produce sound; inversely, when the coil 3 is energized in a negative direction, the hanging end 222 of the diaphragm 22 is magnetized to take on S-pole, the S-pole of the first permanent magnet 41 exerts a downward repelling force on the diaphragm 22, and the N-pole of the second permanent magnet 42 exerts a downward attracting force on the diaphragm 22, so that the diaphragm 22 vibrates the sealing membrane 23 downward, driving the air inside the first cavity 13 to vibrate downward along with the diaphragm 22, so as to realize a process of sound production by reciprocating vibration inside the first cavity 13.

In the phone receiver of the present embodiment, the diaphragm, the electromagnetic coil and the permanent magnets constitute a core part of the phone receiver to form an electromagnetic vibration system. The main parametric variables of the vibration system are acoustic stiffness (mechanical stiffness), mass and mechanical impedance, and by changing the structure to optimize these three parametric variables, the demanded requirements can be realized and met.

When an acoustic system reaches a steady state, in order for the sound pressure (corresponding to the loudness) to keep constant when the frequency changes, the displacement of the diaphragm 22 must be constant. When the moving speed of the diaphragm 22 is V, the driving force is F, the mechanical impedance of the vibration system is Z, the displacement of the vibrating diaphragm is $\xi$ and the angular frequency of the vibration is $\omega$, the vibration system should meet the following formula:

$$V = \frac{F}{Z} = \frac{d}{df}\xi = j\omega\xi$$

Under the condition of a certain driving force, the vibration system must be a stiffness-controlled system, i.e., the impedance of the vibration system must be the stiffness, and:

$$Z \propto \frac{1}{j\omega}$$

When the driving force frequency f is far lower than the natural frequency $f_0$ of the vibration system, i.e., $f \ll f_0$, the elasticity of the vibration system plays a major role in the vibration system, and the vibration system is in an elasticity-controlled zone. When the driving force frequency f is far higher than the natural frequency $f_0$ of the vibration system, i.e., $f \gg f_0$, the mass of the vibration system plays a major role in the vibration system, and the vibration system is in a mass-controlled zone. For a vibration system, its resonance frequency meets the following formula:

$$f_0 = \frac{1}{2\pi}\sqrt{\frac{k}{m}}$$

In this formula, k is the stiffness of the vibration system, and m is the mass of the moving part of the vibration system.

The low-frequency response of a phone receiver determines its performance to a great extent, and in the low-frequency band, the amplitude of the vibrating displacement of the vibration part is directly proportional to the driving force F, according to the Hooke law:

$$F = k\xi$$

It can be seen that, the factors affecting the dynamic performance of the diaphragm's vibration include its elasticity and its inertia. A vibration diaphragm with linear elasticity probably has good dynamic performance, can reasonably reconstruct and play back the sound signals, and has more balanced audio performance; and a diaphragm with a light mass has a small moving inertia, and can better manifest the clarity and detailed parts of the sound. Therefore, in the low-frequency band, the resonance frequency $f_0$ should be made as low as possible, which means the stiffness of the diaphragm should be made as low as possible in order to improve the low-frequency response. This condition can be realized by a process of local thinning at a root portion of the diaphragm.

For instance, the first portion of the diaphragm has a thickness smaller than that of the second portion, so as to reduce the fastening force between the diaphragm 22 and the first mounting segment 211 of the frame 21, increase the elasticity of the diaphragm 22, and thus improve the low-frequency performance of the phone receiver. Or, only the root portion of the diaphragm 22 fixed on the frame 21 is locally thinned, which can also improve the low-frequency performance of the phone receiver.

In the high-frequency band, the resonance frequency $f_0$ should be made as high as possible, which means the stiffness of the diaphragm 22 should be made as high as possible in order to improve the high-frequency response to obtain a relatively wide effective frequency band; and the moving inertia of the diaphragm 22 should be made as small as possible in order to improve the instantaneous response. This condition can be realized by processing the non-magnetic-force-acted region at a front portion of the diaphragm (the hanging end of the diaphragm) in a certain way, e.g., thinning this portion of the diaphragm, or embedding an ultra-thin light alloy plate therein with a reinforcing rib 226 press-formed thereon.

For example, the second portion of the diaphragm 22 has a thickness smaller than that of the first portion, so as to reduce the mass of the diaphragm 22, thereby improving the high-frequency performance of the phone receiver. Or, only the hanging end of the diaphragm 22 is locally thinned.

For a gas chamber (the first cavity 13) having a volume of V, when the amplitude ξ of the vibrating displacement of the diaphragm 22 is a constant value, the effective area S plays a key role in the sound pressure P generated by the vibration, according to the following formula:

$$P = \frac{P_0 c^2 S \xi}{V}$$

In this formula, c is the sound speed, and Po is the reference sound pressure.

That is to say, a larger effective area of the diaphragm 22 for vibrating in the vibration system leads to a higher sound pressure. In the present embodiment, because, during the whole vibration process, the sealing membrane 23 is spreading on the entire diaphragm 22, with the portion of the diaphragm 22 located in the inner hole of the coil 2 also vibrating, so that this area portion of the diaphragm in the inner hole of the coil is fully utilized to make the entire diaphragm 22 of the vibration membrane assembly all contribute to vibration, and thus the effective vibrating area of the diaphragm 22 for is increased, thereby maximally bringing the sound pressure capability into play, increasing the loudness of the phone receiver and improving the sound-producing performance of the phone receiver.

Meanwhile, the phone receiver has a simple structure which is convenient to process, manufacture and assemble. The assembling process of the phone receiver is as follows: respectively pre-fastening the coil 3 and the first permanent magnet 41 on an inner wall of the first casing 11; fastening the second permanent magnet 42 on an inner wall of the second casing 12; passing one end of the frame 21 of the vibration membrane assembly through the coil 3 and fastening this end on the opening of the first casing 11, and directly fastening the other end of the frame 21 on the opening of the first casing 11; finally, the combination of the first casing 11, the vibration membrane assembly and the coil 3 is entirely fastened on the first casing 11.

As shown in FIG. 3, the diaphragm 22 is also provided with two parallel regulating holes 225, such as elongated holes, wherein each regulating hole 225 extends from the coil 3 in a direction towards the permanent magnets. By providing the regulating holes 225, the magnetic field strength distributed by the electromagnetic field generated by the coil 3 on a unit area of the diaphragm 22 is strengthened, so that the interaction between the diaphragm 22 and the fixed magnetic field of the two permanent magnets is intensified, and the loudness of the phone receiver is further increased. Optionally, the regulating hole 225 is communicated with the first gap 24, so as to increase the freedom of vibration of the diaphragm 22, and as a result, under the same electromagnetic driving force, the diaphragm 22 vibrates more easily.

Furthermore, the housing 1 and the diaphragm 22 in this embodiment adopts high-magnetic-conductivity material, a first magnetic circuit is formed by the first permanent magnet 41 with the first casing 11 and the diaphragm 22, a second magnetic circuit is formed by the second permanent magnet 42 with the second casing 12 and the diaphragm 22, and by controlling the thicknesses of the housing 1 and the diaphragm 22 as well as using laser welding between the housing 1 and the vibration membrane assembly, the first and second magnetic circuits can be made to form ideal circuits, so that the electromagnetic performance thereof can be better brought into play. Also, the coil and the two permanent magnets are arranged side by side, so that the thickness of the phone receiver only depends on the thickness of the coil, therefore, phone receivers with different thicknesses can be produced according to demands.

As a first alternative of Embodiment 1, the vibration membrane assembly may also be fixed on an inner wall of the first casing 11 or on an inner wall of the second casing 12.

As a second alternative of Embodiment 1, a reinforcing rib may be formed on the diaphragm 22, for example, a reinforcing rib 226 is formed on a top surface or a bottom surface of the diaphragm 22 so as to increase the rigidity of the diaphragm 22, thereby further increasing the loudness of the phone receiver.

As a third alternative of Embodiment 1, the frame 21 may not be provided with the support parts 214, and additional sealing structure is arranged between the openings of the first casing 11 and the second casing 12 at the location corresponding to the first mounting segment so as to fix the bottom opening of the first casing 11 and the top opening of the second casing 12 to be flush. Or, the frame 21 itself has a rectangular shape, and the portions of the first casing 11 and the second casing 12 at the location for mounting the coil protrude outwards, so that, when the frame 21 is fixed on the housing 1, a mounting area can still be formed between a part of the side wall of the frame 21 and the inner wall of the housing 1, in order for the coil 3 to be sealedly fixed and sleeved on the frame 21.

Embodiment 2

Figure 6:
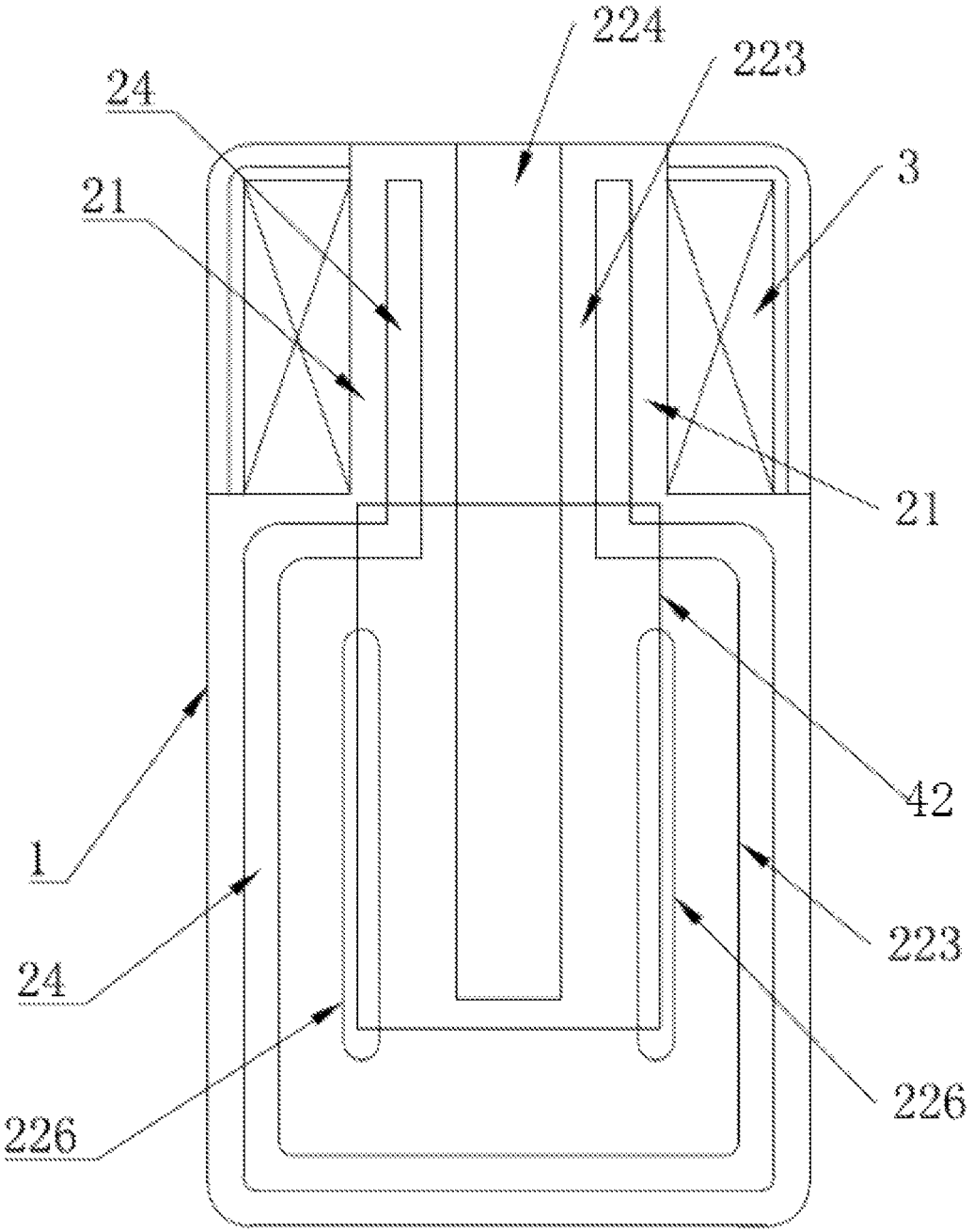
FIG. 6 is a top view of a first kind of phone receiver provided in Embodiment 2 of the present application, after the first casing, the first permanent magnet and the support parts are removed.
Figure 7:
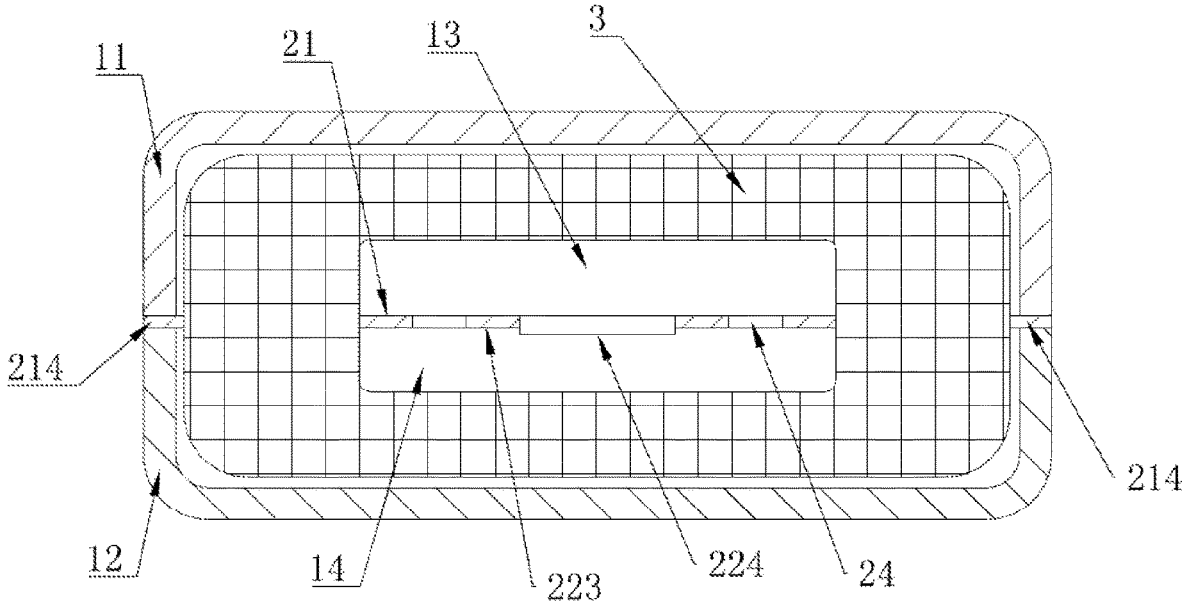
FIG. 7 is a cross-sectional schematic diagram (in the left-and-right direction) of the phone receiver of FIG. 6 along a cross section at the position of the coil.

This embodiment provides a thin-type phone receiver, and as compared to the thin-type phone receiver provided in Embodiment 1, its differences are as follows:

As shown in FIG. 6 and FIG. 7, the diaphragm 22 comprises a diaphragm body 223 and a spring plate 224, one end of the diaphragm body 223 is formed on the frame 21, the other end of the diaphragm body 223 is hanging in an inner space of the frame 21, and a first gap 24 is formed between the diaphragm body 223 and the frame 21, wherein the diaphragm body 223 is made of non-magnetic-conducting material, such as high-elasticity light-weight material, for example, aluminum-magnesium alloy or aluminum alloy, and the spring plate 224 is made of soft magnetic material; the sealing membrane 23 is fixed on the diaphragm body 223 and the frame 21 and covers an entirety of the first gap 24. Optionally, the diaphragm body 223 also comprises a first portion and a second portion like the diaphragm in Embodiment 1. Or, the sealing membrane is fixed on the frame, the diaphragm body and the spring plate.

Figure 8:
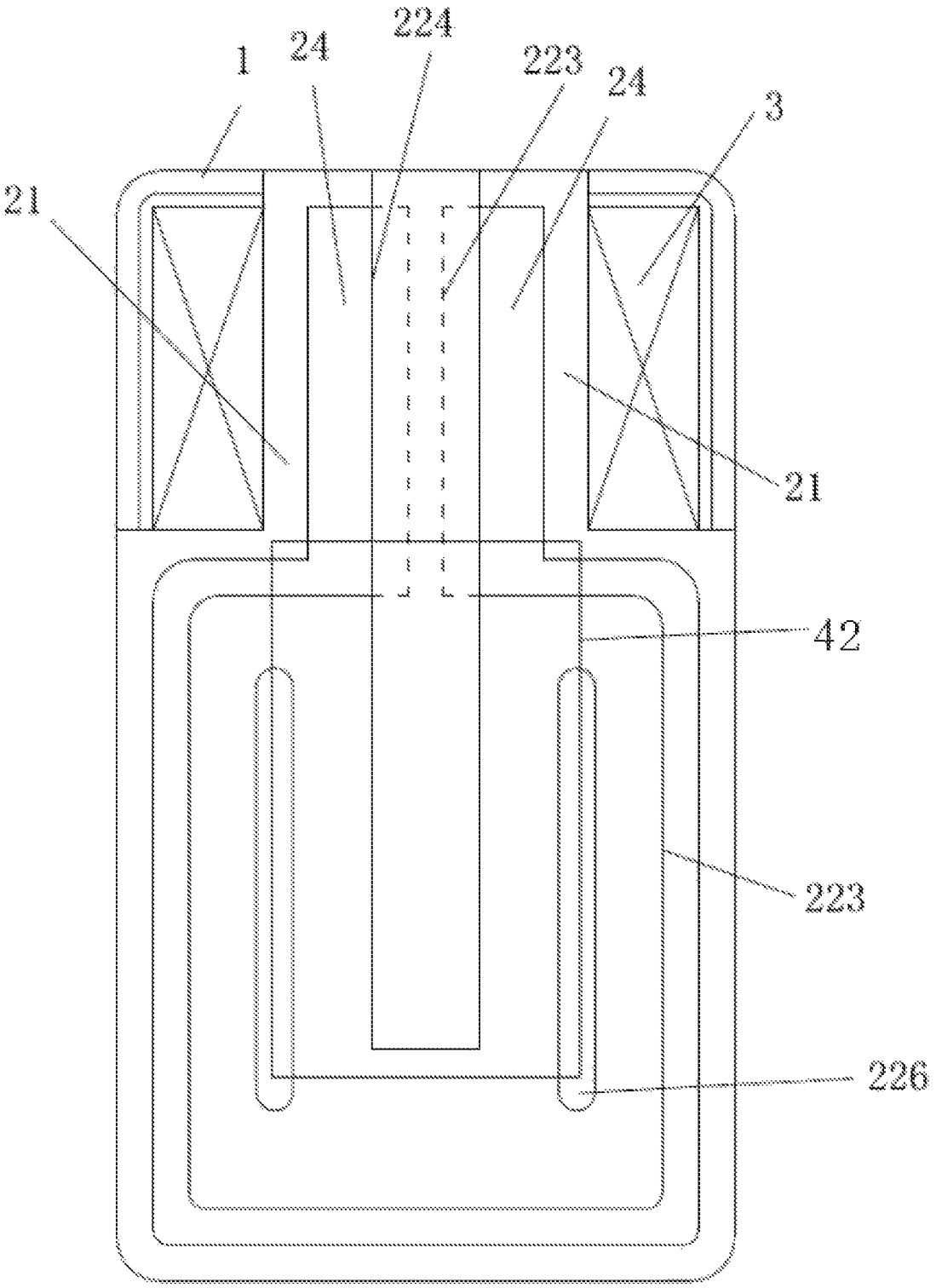
FIG. 8 is a top view of a second kind of phone receiver provided in Embodiment 2 of the present application, after the first casing, the first permanent magnet and the support parts are removed.
Figure 9:
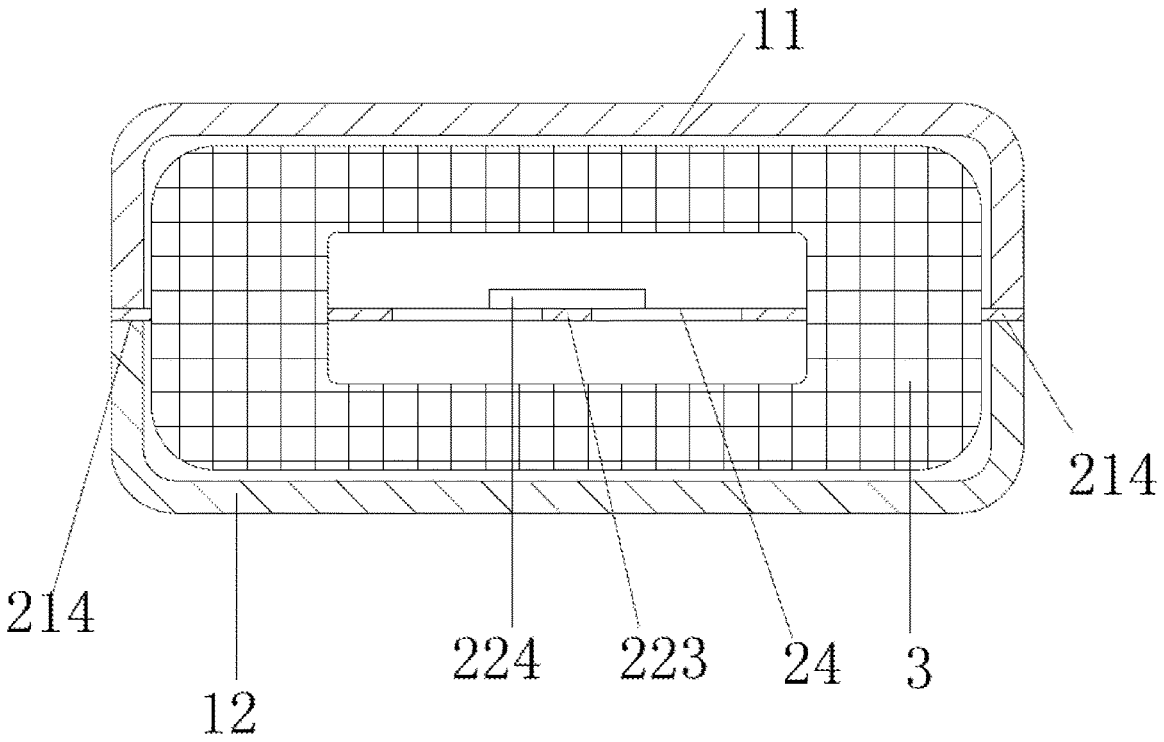
FIG. 9 is a cross-sectional schematic diagram (in the left-and-right direction) of the phone receiver of FIG. 8 along a cross section at the position of the coil.

For instance, as shown in FIG. 7, a mounting hole or a mounting groove is provided on a top surface of the diaphragm body 223, and the spring plate 224 is embedded in the mounting hole or the mounting groove; or, as shown in FIG. 8 and FIG. 9, the spring plate 224 is directly fixed on a top surface of the diaphragm body 223.

Figure 10:
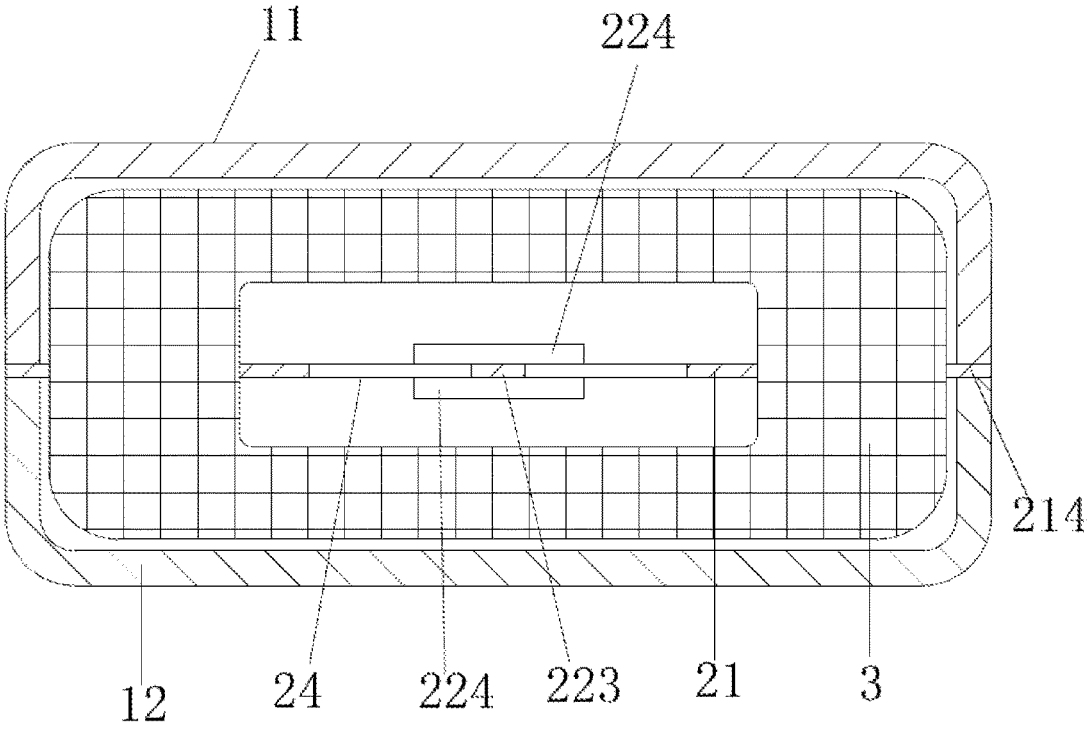
FIG. 10 is a cross-sectional schematic diagram of a third kind of phone receiver provided in Embodiment 2 of the present application.

Or, as shown in FIG. 10, there are two spring plates 224 respectively fixed on a top surface and a bottom surface of the diaphragm body 223. By providing two spring plates 224, the interaction between the electromagnetic field acted on the spring plates 224 and the two permanent magnets are intensified.

As a first alternative of Embodiment 2, the sealing membrane 23 may also cover the spring plate(s) 224, or the sealing membrane 23 is fixed on the spring plate(s) 224 and the frame 21 to at least seal the first gap 24.

Embodiment 3

Figure 11:
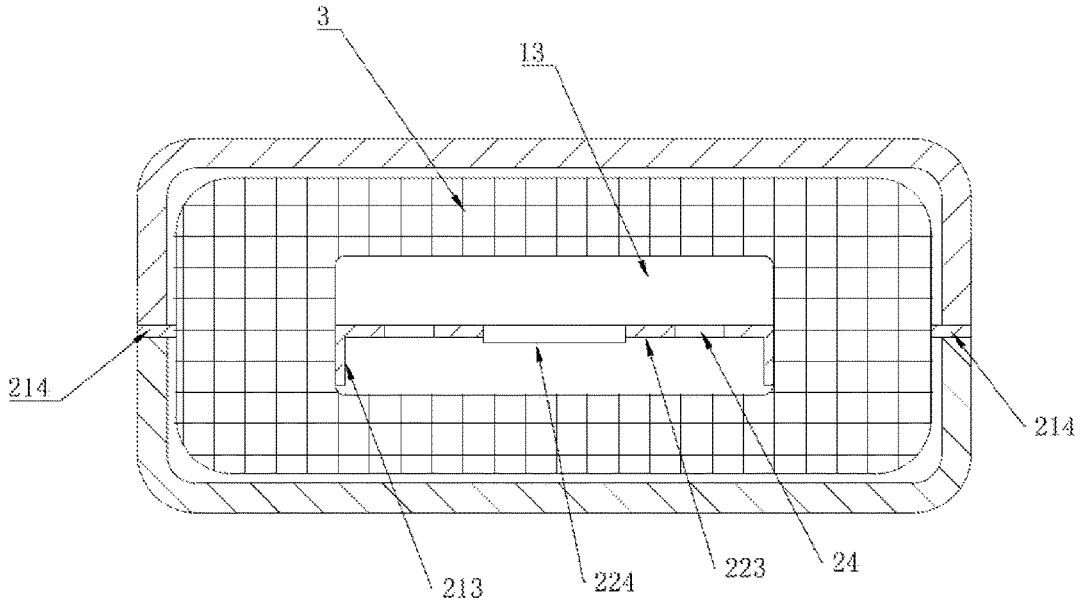
FIG. 11 is a cross-sectional schematic diagram of a phone receiver provided in Embodiment 3 of the present application.

This embodiment provides a thin-type phone receiver, and as compared to the thin-type phone receivers provided in Embodiment 1 and Embodiment 2, its differences are as follows:

On the basis of the technical solution of Embodiment 1 or on the basis of the technical solution of Embodiment 2, as shown in FIG. 11, two first extension parts 213 bending towards the second cavity are provided at a location of side walls of the frame 21 connecting to the inner wall surface of the coil 3. That is to say, both lateral sides of the first mounting segment 211 are respectively provided with a first extension part 213 bending towards the second cavity, and with the coil 3 being sleeved outside the two first extension part 213, two side walls of the inner hole of the coil 3 are respectively sealedly fixed to an outer wall of one first extension part 213.

In this embodiment, by providing the first extension parts 213 on the first mounting segment of the frame 21, the firmness of the sealed connection between the inner hole wall of the coil 3 and the side wall of the frame 21 is enhanced, so as to ensure that the vibration membrane assembly separates the mounting cavity of the housing 1 into a first cavity 13 and a second cavity 14 that are arranged side by side, and that the entire diaphragm 22 can vibrate to contribute to the whole sound-producing process, thereby further ensuring the improvement of the loudness of the phone receiver.

As alternatives, the first extension part(s) 213 may be one, or more, such as three, four or five, so as to enhance the firmness of the connection between the first mounting segment 211 of the frame 21 and the coil 3.

Embodiment 4

Figure 12:
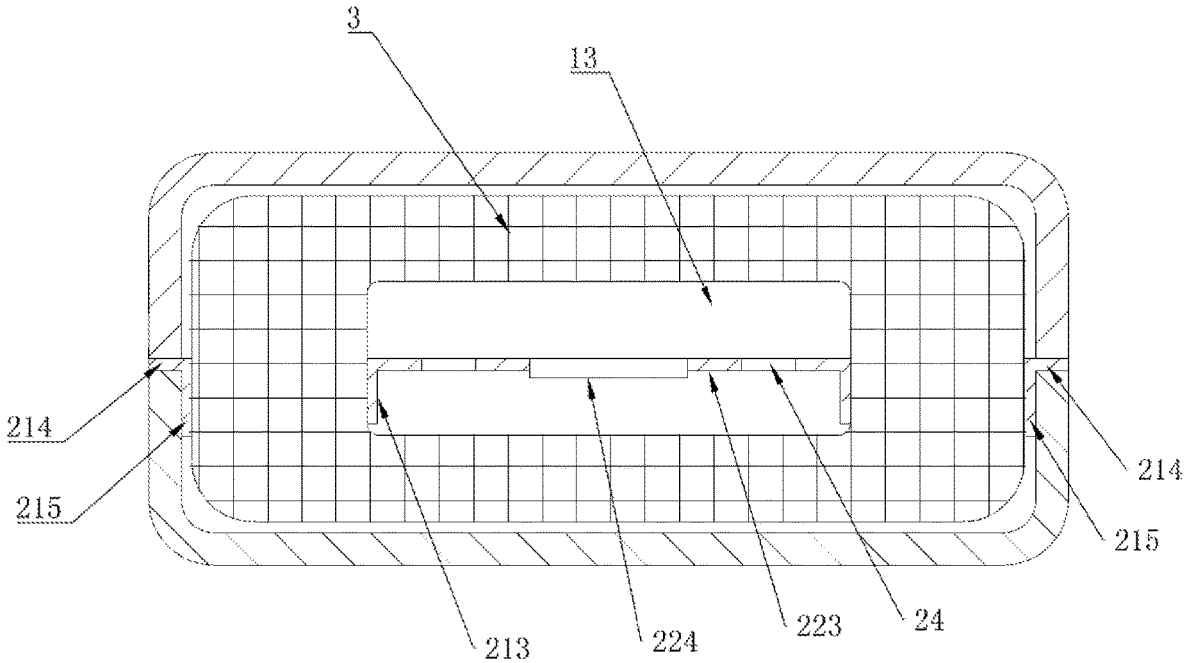
FIG. 12 is a cross-sectional schematic diagram of a phone receiver provided in Embodiment 4 of the present application.

This embodiment provides a thin-type phone receiver, and as compared to the thin-type phone receiver provided in Embodiment 3, its differences are as follows: on the basis of the technical solution of Embodiment 3, as shown in FIG. 12, two second extension parts 215 bending towards the second cavity 14 are provided at a bottom of the support parts 214, wherein the inner surfaces of the two second extension parts 215 are respectively fixed on both outer sides of the coil 3, so that, by the cooperation of the first extension parts 213 and the second extension parts 215, the inner hole wall of the coil 3 is fixed with the first extension parts 213, and the outer wall of the coil 3 is fixed with the second extension parts 215, so as to further enhance the fastening between the coil 3 and the frame 21 to increase firmness.

Embodiment 5

Figure 13:
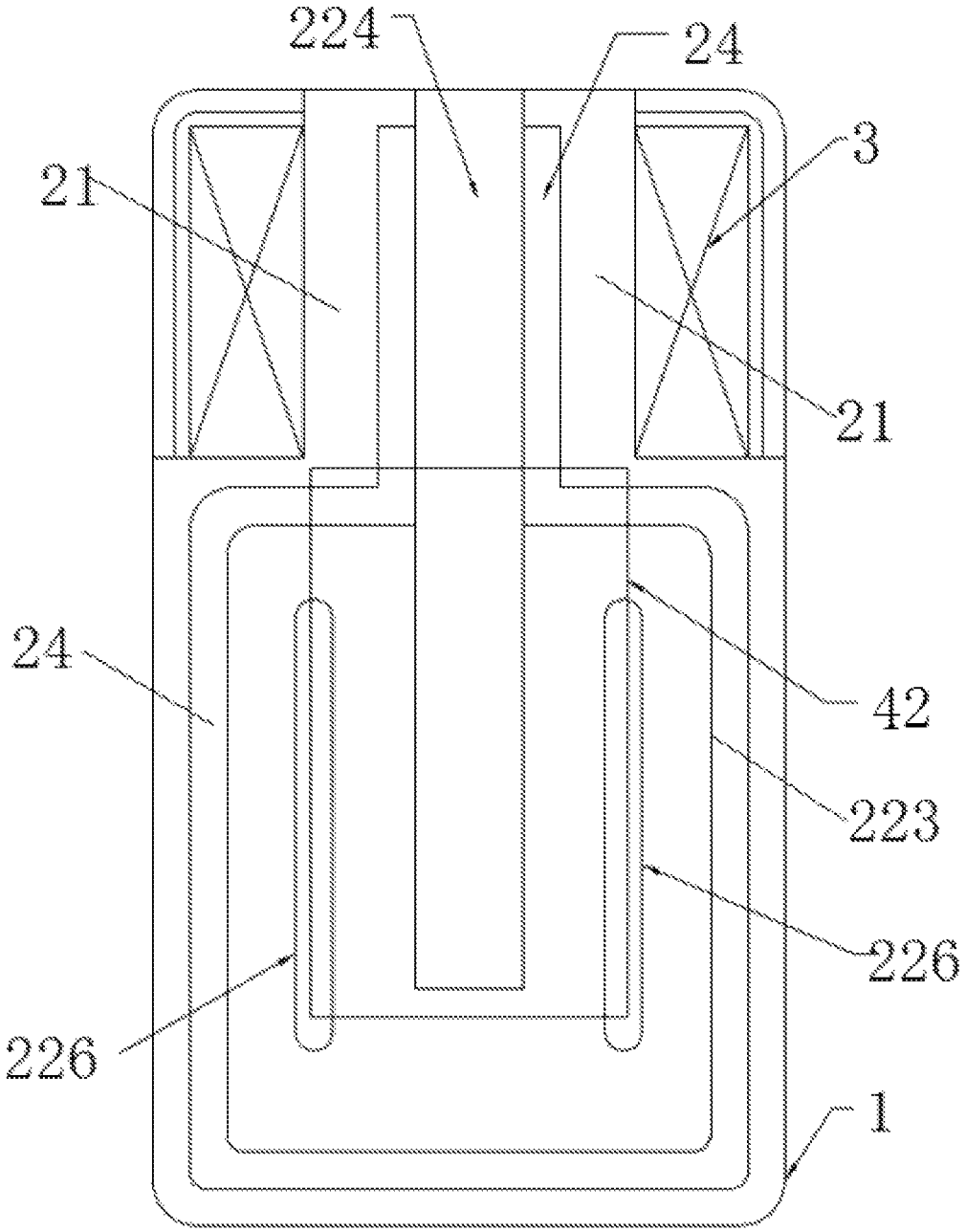
FIG. 13 is a top view of a first kind of phone receiver provided in Embodiment 5 of the present application, after the first casing, the first permanent magnet and the support parts are removed.
Figure 14:
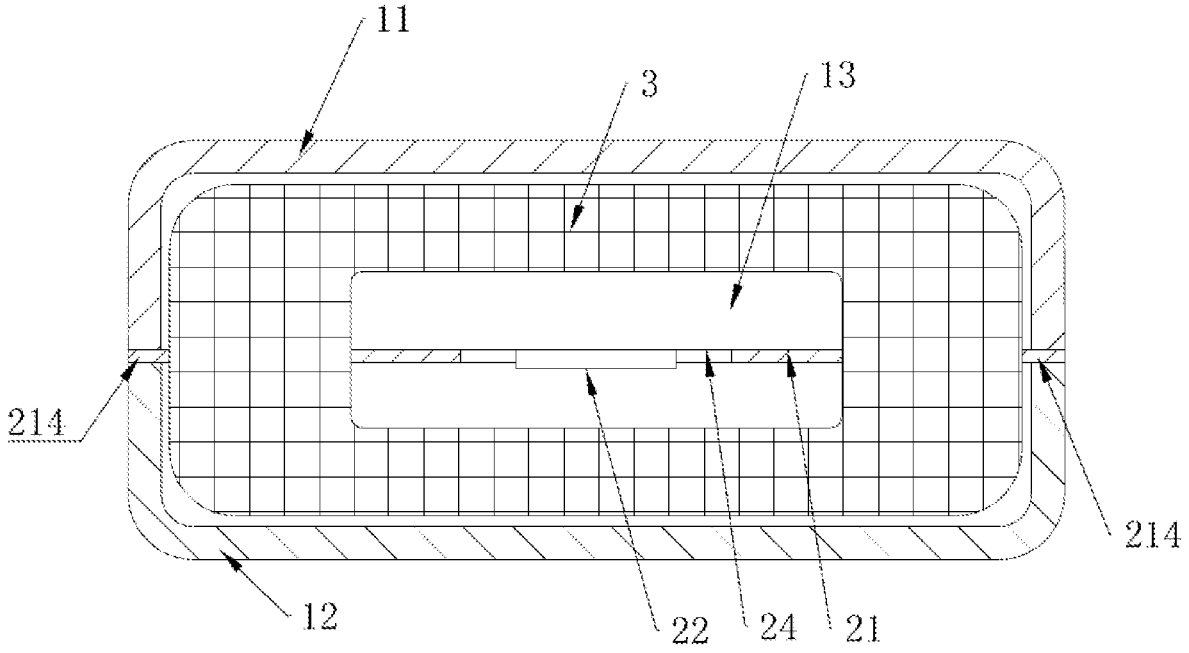
FIG. 14 is a cross-sectional schematic diagram (in the left-and-right direction) of the phone receiver of FIG. 13 along a cross section at the position of the coil.

This embodiment provides a thin-type phone receiver, and as compared to the thin-type phone receiver provided in Embodiment 2, its differences are as follows:

As shown in FIG. 13 and FIG. 14, the diaphragm body 223 only comprises the second portion, and the spring plate 224 has one end fixed on the diaphragm body 223 and the other end fixed on the first mounting segment 211 of the frame 21, that is to say, one end of the diaphragm body 223 is fixed to the frame through the spring plate 224 fixed thereon. For instance, the spring plate 224 is fixed to a top surface of the diaphragm body 223, which can also realize the aforementioned vibration and sound producing process.

Figure 15:
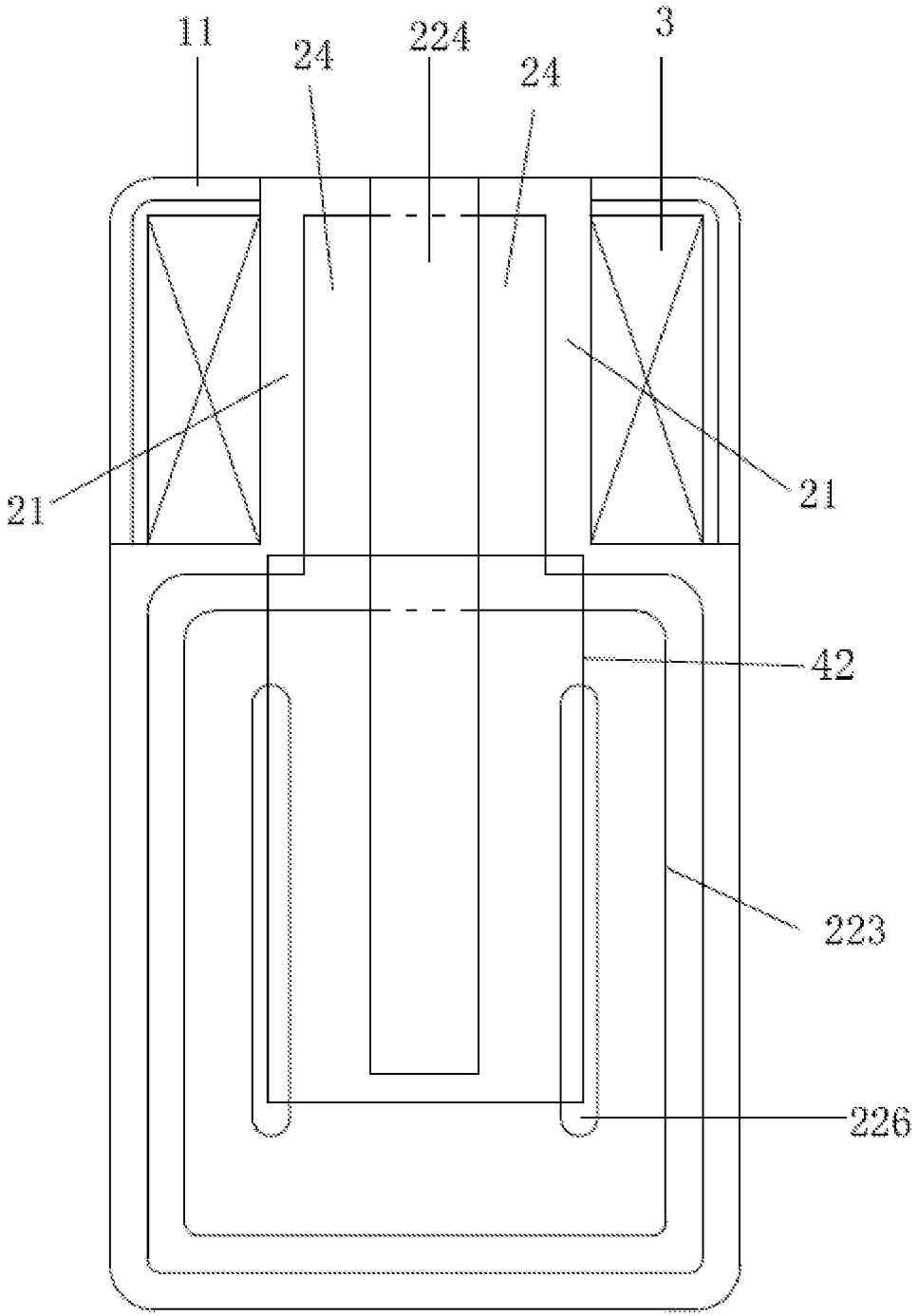
FIG. 15 is a top view of a second kind of phone receiver provided in Embodiment 5 of the present application, after the first casing, the first permanent magnet and the support parts are removed.
Figure 16:
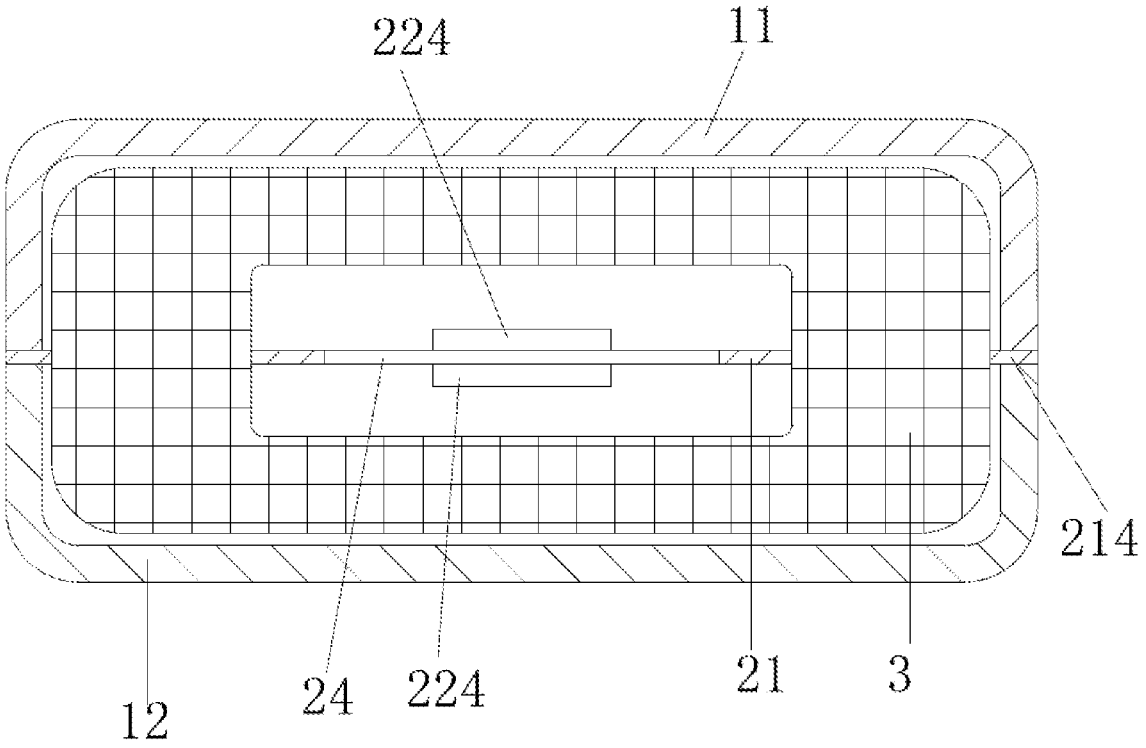
FIG. 16 is a cross-sectional schematic diagram (in the left-and-right direction) of the phone receiver of FIG. 15 along a cross section at the position of the coil.

Or, as shown in FIG. 15 and FIG. 16, there are two spring plates 224, one end of which is respectively fixed on a top surface and a bottom surface of the diaphragm body 223, and the other end of which extending inside the coil are both fixed on the first mounting segment of the frame, which can also realize the aforementioned vibration and sound producing process.

Embodiment 6

Figure 17:
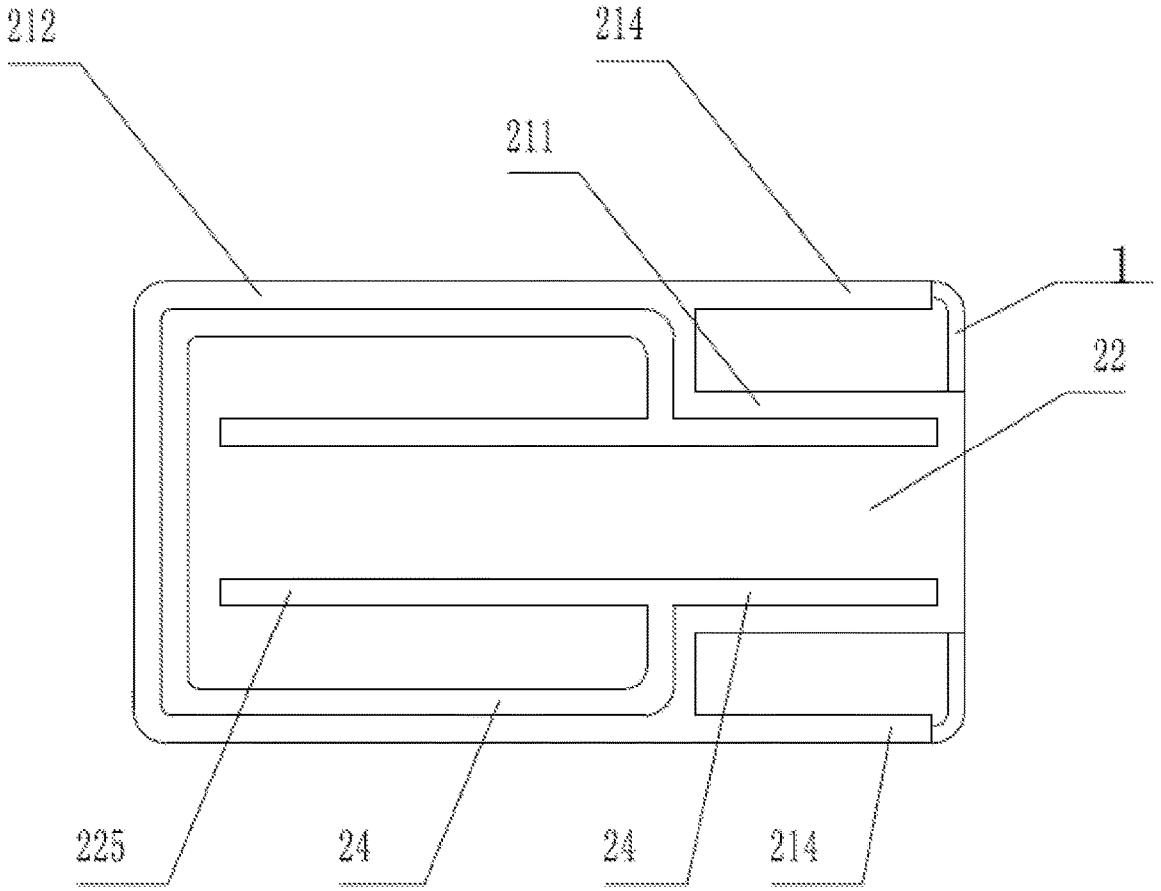
FIG. 17 is a schematic diagram of the vibration membrane assembly of a phone receiver provided in Embodiment 6 of the present application.

This embodiment provides a thin-type phone receiver, and as compared to the thin-type phone receiver provided in Embodiment 1, its differences are as follows:

As shown in FIG. 17, the support parts 214 of the frame 21 thereof are different from the support parts 214 of the frame 21 in Embodiment 1 (as shown in FIG. 5), the two support parts 214 in this embodiment are parallel to the first mounting segment and located on both sides of the first mounting segment, but the support parts 214 are not fixed to the first mounting segment 211 and do not surround the first mounting segment 211; the support parts 214 are also fixed on the housing, for example, being fixedly clamped between a bottom opening of the first casing 11 and a top opening of the second casing 12, wherein the frame 21 can also be fixed smoothly at level onto the housing, thereby making it easy to mount the phone receiver.

Embodiment 7

This embodiment provides a thin-type phone receiver, and as compared to the thin-type phone receiver provided in any of Embodiments 1 to 6, its differences are as follows:

The sealing membrane 23 is not fixed on the diaphragm 22, and instead, it is spreading and fixed on the entire frame 21, still being able to sealedly cover the entirety of the first gap 24 between the frame 21 and the diaphragm 22; or, the sealing membrane 23 is directly fixed on an inner surface of the housing 1 and the inner hole of the coil 3, without being fixed on the frame 21, and it is still able to sealedly cover the entirety of the first gap 24 between the frame 21 and the diaphragm 22 while allowing the portion of the diaphragm 22 extending inside the inner hole of the coil to vibrate and produce sound, so as to increase the effective vibrating area of the diaphragm and improve the loudness of the phone receiver.

Embodiment 8

Figure 18:
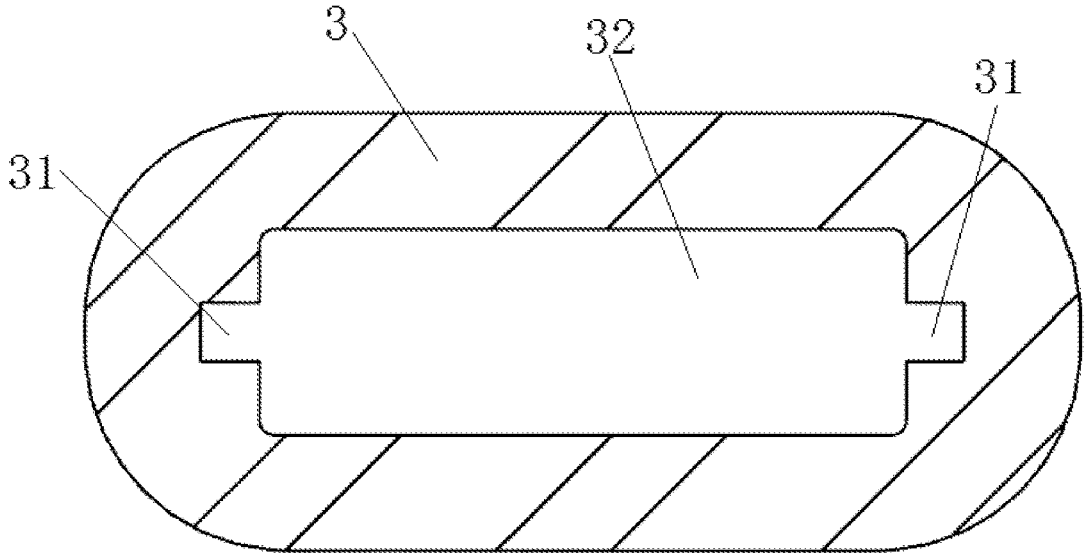
FIG. 18 is a schematic diagram of a first kind of structure of the coil of a phone receiver provided in Embodiment 8 of the present application.
Figure 19:
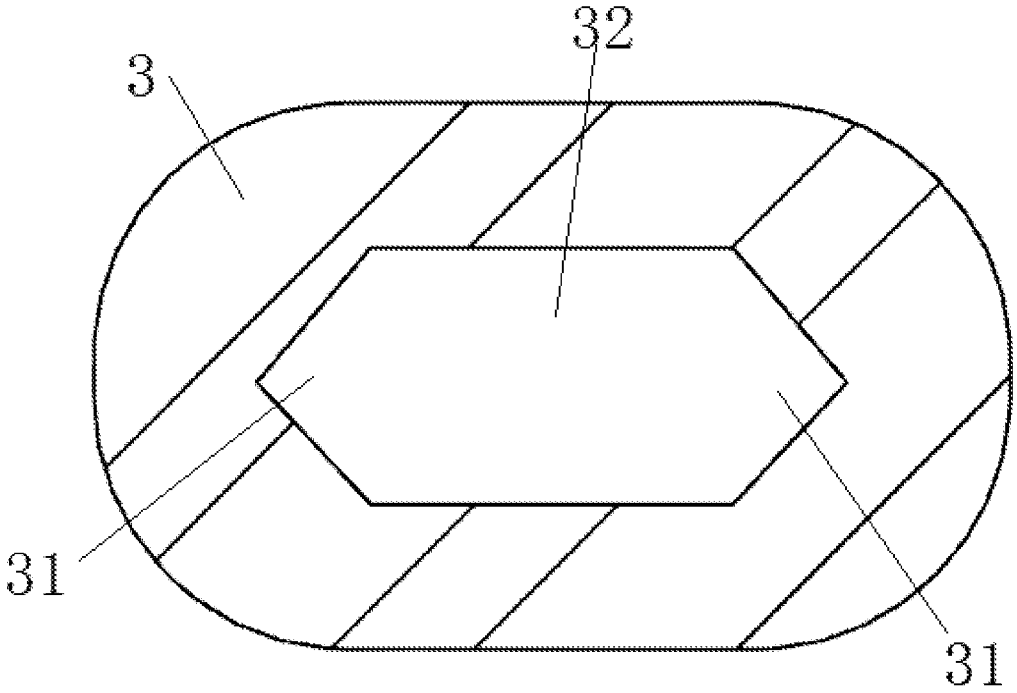
FIG. 19 is a schematic diagram of a second kind of structure of the coil of a phone receiver provided in Embodiment 8.
Figure 20:
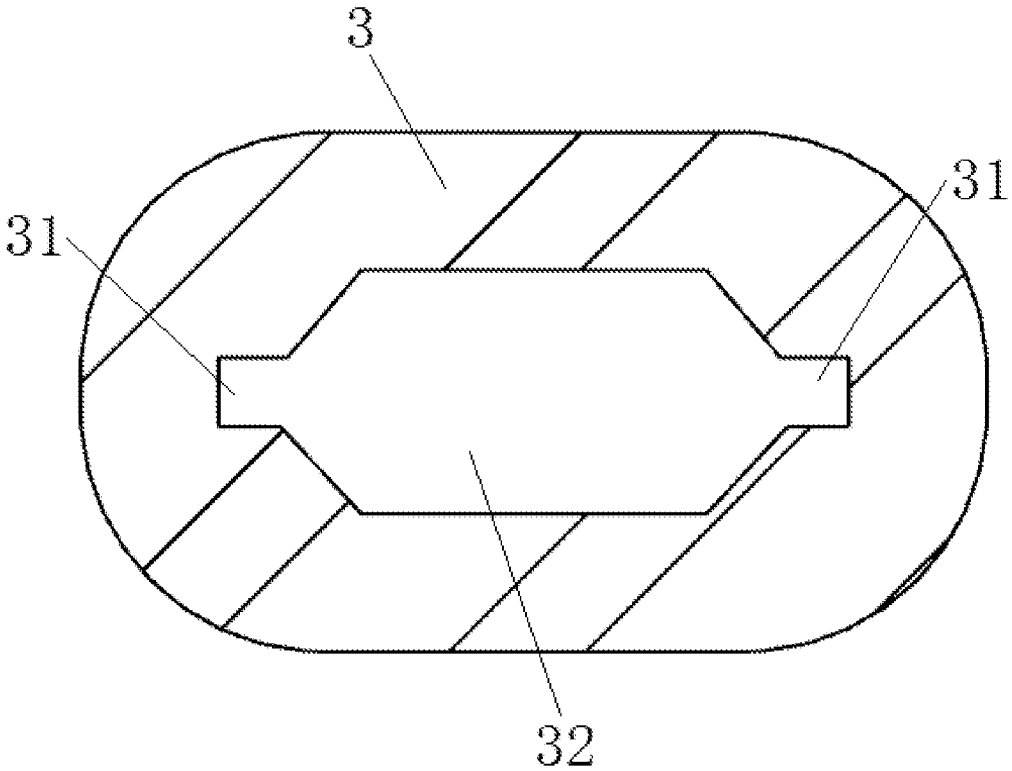
FIG. 20 is a schematic diagram of a first kind of structure of the coil of a phone receiver provided in Embodiment 8.

This embodiment provides a thin-type phone receiver, and as compared to the thin-type phone receiver provided in any of Embodiments 1 to 7, its differences are as follows:

The coil has a different structure, and specifically, as shown in FIG. 18 to FIG. 20, two symmetric positioning parts 31 are provided on the inner hole wall of the coil 3, and the coil 3 is sleeved on the frame 21 through the positioning parts 31. The providing of the positioning parts 31 may facilitate the sleeving of the coil 3 onto the frame 21 for assembling.

In particular, the positioning parts 31 are grooves recessed inward on the inner hole wall of the coil 3; both lateral sides of the first mounting segment 211 of the frame 21 are respectively embedded in the grooves adjacent thereto, and by symmetrically positioning the two positioning parts 31, after the coil 3 is properly mounted onto the first mounting segment 211, the first mounting segment 211 can be positioned in a horizontal state.

For instance, as shown in FIG. 18, the grooves have a U-shaped cross section, and when the coil 3 is assembled onto the frame 21, it only needs to pass both lateral sides of the first mounting segment 211 respectively through a U-shaped groove as the first mounting segment 211 is passed through the inner hole of the coil, the two groove walls of the U-shaped grooves can have a positioning effect for locking the position of the first mounting segment 211, so as to facilitate properly mounting the coil onto the first mounting segment 211. For example, gluing adhesive can be provided on an inner wall surface of the U-shaped groove, so that, when the first mounting segment 211 is inserted into the U-shaped groove, the first mounting segment can be glued in the U-shaped groove, so as to realize sealed sleeving of the coil 3 onto the first mounting segment 211.

Or, as shown in FIG. 19, the grooves have a V-shaped cross section, and both lateral sides of the first mounting segment 211 are respectively embedded into a V-shaped groove, which can also realize position-locking of the first mounting segment 211 when the coil is sleeved onto the first mounting segment 211.

Or, as shown in FIG. 20, the grooves may also have a cross-section including a U-shaped part and an inverted-trapezoidal-shaped part joined to an opening of the U-shaped part, with a longer edge side of the inverted-trapezoidal-shaped part forming a groove opening of the groove, and both lateral sides of the first mounting segment 211 are respectively embedded into a U-shaped groove via the inverted-trapezoidal-shaped part, which can also realize position-locking when the first mounting segment 211 cooperates with the coil 3. By providing the inverted-trapezoidal-shaped part, the groove openings of the grooves are made to have a flaring structure, so that, when the first mounting segment 211 is being embedded into the U-shaped groove, the inner hole wall of the coil 3 would not collide with the first mounting segment 211.

As an alternative, the grooves may also have a cross-section of other shapes, for example, the cross-section of the grooves may be a W-shape or a S-shape, and correspondingly, both lateral sides of the frame to be cooperating with such grooves are arranged to have a shape suitable for being embedded into such grooves.

As an alternative, the aforementioned grooves may also be replaced with other types of positioning parts 31, for example, the positioning parts 31 are stepped surfaces provided on the inner hole wall of the coil 3, and both lateral sides of the first mounting segment 211 are respectively lap-joint to a stepped surface.

As an alternative, the positioning parts 31 are protrusions provided on the inner hole wall of the coil 3, and correspondingly, slots are provided on both lateral sides of the first mounting segment 211, the slots are connected on the protrusions in a sleeving manner, which can also realize mounting and position-locking when the coil 3 cooperates with the frame 21. Or, the positioning parts 31 may also be other structures, as long as the structure can realize position-locking when mounting the coil 3 to the frame 21, that is to say, a positioning part may be provided on the inner hole wall of the coil as long as position-locking can be realized by the cooperation between this positioning part and a lateral side of the frame, for mounting the coil 3 to the frame 21.

Also, optionally, the inner hole 32 of the coil 3 may be a rectangular inner hole. Of course, it may also be a circular inner hole, or an inner hole of other shapes.

Apparently, the aforementioned embodiments are merely examples illustrated for clearly describing the present application, rather than limiting the implementation ways thereof. For a person with ordinary skill in the art, various changes and modifications in other different forms can be made on the basis of the aforementioned description. It is unnecessary and impossible to exhaustively list all the implementation ways herein. However, any obvious changes or modifications derived from the aforementioned description are intended to be embraced within the protection scope of the present application.

What is claimed is:

1. A thin-type phone receiver, comprising:

a housing, having a mounting cavity;

a vibration membrane assembly, comprising:

a frame sealedly fixed on the housing wherein a mounting area is formed by a part of a side wall of the frame and an inner wall of the housing, a diaphragm at least partially made of soft magnetic material and fixed on the frame with one end of the diaphragm hanging in an inner space of the frame, and a sealing membrane;

a coil, sealedly fixed in the mounting area and sealedly sleeved on the frame, wherein the vibration membrane assembly separates the mounting cavity into a first cavity and a second cavity that are arranged side by side and separate from each other;

wherein the vibration membrane assembly separates the mounting cavity into a first cavity and a second cavity that are arranged side by side and not communicated with each other;

the diaphragm comprises a first portion fixed on the frame and extending into the inner hole of the coil, and a second portion formed on the first portion and hanging outside the coil, wherein the second portion has a width in a radial direction of the coil larger than that of the first portion, and wherein a first gap is formed between the diaphragm and the frame, and the sealing membrane sealedly covers an entirety of the first gap, such that the first portion of the diaphragm extending into the inner hole of the coil can generate vibration.

2. The thin-type phone receiver according to claim 1, wherein the second portion has a thickness not equal to that of the first portion.

3. The thin-type phone receiver according to claim 1, wherein the second portion is provided with a regulating aperture extending in the same direction as the first gap.

4. The thin-type phone receiver according to claim 1, wherein the frame comprises:

a first mounting segment sealedly fixed in the inner hole of the coil and forming the mounting area with the housing, and a second mounting segment placed outside the coil and fixed on the first mounting segment, wherein, the second mounting segment has a width in a radial direction of the coil larger than that of the first mounting segment, one end of the coil facing the second mounting segment is sealedly fixed on the second mounting segment, and the coil is sealedly fixed to the housing.

5. The thin-type phone receiver according to claim 4, wherein the frame also comprises a first extension part bending towards the second cavity and arranged on at least one end of the second mounting segment, wherein the first extension part is sealedly fixed to an inner hole wall of the coil.

6. The thin-type phone receiver according to claim 4, wherein the frame also comprises at least two support parts formed on an end portion of the second mounting segment for fixing the first mounting segment and located on both sides of the first mounting segment, wherein the support parts are fixed on the housing and surround the mounting area with the first mounting segment, an outer wall of the coil is fixed on the support parts.

7. The thin-type phone receiver according to claim 4, wherein the coil is fixed by sealant adhesive to the second mounting segment, the first mounting segment and the housing.

8. The thin-type phone receiver according to claim 1, wherein the diaphragm comprises:

a diaphragm body with one end formed on the frame and the other end hanging in the inner space of the frame; and at least one spring plate, fixed on the diaphragm body, made of soft magnetic material and extending on the diaphragm body at least from an inner hole of the coil in an extending direction of the first gap, wherein, the diaphragm body is made of non-magnetic-conducting material, and the sealing membrane is fixed on the diaphragm body and the frame.

9. The thin-type phone receiver according to claim 1, wherein the housing comprises:

a first casing and a second casing with mutually buckled openings; and the frame is clamped and fixed between the openings of the first casing and the second casing.

10. The thin-type phone receiver according to claim 1, wherein:

at least one reinforcing rib is provided on one side surface of the diaphragm; and/or the sealing membrane is spreading and fixed on the frame and the diaphragm.

11. The thin-type phone receiver according to claim 1, wherein at least one positioning part is provided on an inner hole wall of the coil, and the coil is sleeved on the frame through the positioning part.

12. The thin-type phone receiver according to claim 11, wherein the positioning part is a groove recessed inward on the inner hole wall of the coil; and a lateral end of the frame is embedded in the groove adjacent thereto.

13. The thin-type phone receiver according to claim 12, wherein:

the groove has a U-shaped cross section or a V-shaped cross section; or the groove has a cross-section including a U-shaped part and an inverted-trapezoidal-shaped part joined to an opening of the U-shaped part, and a longer edge side of the inverted-trapezoidal-shaped part forms a groove opening of the groove.

14. The thin-type phone receiver according to claim 11, wherein comprising two of the positioning parts symmetrically disposed on the inner hole wall of the coil.

* * * * *